US006199923B1

(12) United States Patent
Rice et al.

(10) Patent No.: US 6,199,923 B1
(45) Date of Patent: Mar. 13, 2001

(54) VEHICLE DOOR LATCH

(75) Inventors: John R. Rice, Clinton Township, Macomb County; Ian Martin, Waterford, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/329,519

(22) Filed: Jun. 10, 1999

(51) Int. Cl.[7] ..... E05C 3/06

(52) U.S. Cl. ..... 292/216; 292/DIG. 23; 70/283

(58) Field of Search ..... 292/201, 216, 292/DIG. 23, DIG. 65; 70/283

(56) References Cited

U.S. PATENT DOCUMENTS 3,098,671 * 7/1963 Moss ..... 292/221
3,111,339 * 11/1963 Nadeau ..... 292/216
4,875,723 * 10/1989 Compeau ..... 292/201
4,900,074 * 2/1990 Kleefeldt ..... 292/216
4,969,673 * 11/1990 Portelli ..... 292/216
5,439,261 * 8/1995 O'Hare ..... 292/336.3
5,537,848 * 7/1996 Grzanka ..... 70/279
5,715,713 * 2/1998 Aubry ..... 70/277
5,802,894 * 9/1998 Jahrsetz ..... 70/264

* cited by examiner

*Primary Examiner*—Gary W. Estremsky
(74) *Attorney, Agent, or Firm*—Patrick M. Griffin

(57) ABSTRACT

A vehicle door latch (10) with a power child security lock comprises an enclosure (12) and several components mounted on or in the enclosure. First is a latching assembly (14) disposed in the enclosure and adapted to move between an unlatched configuration and a latched configuration. There is also an inside latch handle assembly (16) disposed adjacent the latching assembly (14). The inside latch handle assembly (16) transfers motion to the latching assembly in response to an actuator to move the latching assembly to the unlatched configuration. A child security lock assembly (22) for the inside latch handle assembly (16) includes a lock pin (24) that is moveable between a locked position and an unlocked position. In the locked position, the lock pin (24) engages the inside latch handle assembly (16) to prevent any motion transfer to the latching assembly (14). In the unlocked position, the lock pin (24) disengages the inside latch handle assembly (16) to allow motion transfer to the latching assembly (14 ). The child security lock assembly (22) also includes a motor assembly (26) disposed adjacent the lock pin (24), and a linkage (30) interconnecting the lock pin and the motor assembly wherein the motor assembly controls movement of the lock pin.

7 Claims, 6 Drawing Sheets

VEHICLE DOOR LATCH

TECHNICAL FIELD

The present invention relates to a vehicle door latch, and more particularly to a vehicle door latch having a child security mechanism.

BACKGROUND OF THE INVENTION

Vehicle manufacturers have concerned themselves with child security features on door latches, and especially rear door latches. Presently there are several types of child security locks for disabling the rear inside door latch handle of a vehicle.

One type of security lock involves a hand-operated lever that pivots into and out of engagement with the door latch components. The purpose of the lever is to engage one or more of these components to block or arrest motion transfer along the motion transfer path between the rear inside door latch handle and the latching assembly that unlatches the rear door. In order to operate the lever, a person must open the rear door to access the lever, which is located adjacent the door latch.

Another type of hand-activated system is a free-wheeling system. In such a system, some of the motion-transferring components in the latch's motion transfer path can switch into a free-wheeling or lost motion mode wherein they do not transfer motion from the inside latch handle to the latching assembly.

These manually operated systems are effective; but they lack convenience. For example, the driver may want to activate the security lock while seated in the vehicle—perhaps even while driving. This is not possible without a power system for activating the lock, with a switch located near the driver seat.

There are power security lock systems of the type shown in U.S. Pat. Nos. 5,511,838 to Baughman et al; and 5,263,751 to Priest et al. These systems each involve an electro-mechanical assembly disposed in the motion transfer path between the inside latch handle and the latching assembly. But in both cases the electro-mechanical assembly is positioned in the middle of the door—mid-way between the latch handle and the latching assembly. Both systems involve establishing a free-wheeling junction along the motion transfer path between the inside latch handle and the latching assembly. Thus, when the lock is activated, the motion transfer path is broken, and the inside latch handle will simply free-wheel. These two power systems are effective, but they leave room for improvement in the area of simplicity and packaging. Both are complex assemblies involving several parts; and both involve installation in the middle of the door and remote from the latching assembly. This translates into higher labor and material costs, and possibly higher vehicle weight.

SUMMARY OF THE INVENTION AND ADVANTAGES

The present invention is a comparatively compact and simple arrangement for providing a power child security lock for a vehicle door latch assembly.

The present invention comprises an enclosure and several components mounted on or in the enclosure. First is a latching assembly disposed in the enclosure and adapted to move between an unlatched configuration and a latched configuration. There is also an inside latch handle assembly disposed adjacent the latching assembly for transferring motion to the latching assembly in response to an actuator to move the latching assembly to the unlatched configuration. A child security lock assembly for the inside latch handle assembly includes a lock pin. The lock pin is moveable between a locked position in which the lock pin engages the inside latch handle assembly to prevent any motion transfer to the latching assembly, and an unlocked position in which the lock pin disengages the inside latch handle assembly to allow motion transfer to the latching assembly. The child security lock assembly also includes a motor assembly disposed adjacent the lock pin, and a linkage interconnecting the lock pin and the motor assembly wherein the motor assembly controls movement of the lock pin.

FIGURES IN THE DRAWINGS

The present invention will now be described, by way of example, with reference to the accompanying drawings, in which.

DESCRIPTION OF THE PREFERRED EMBODIMENT

Figure 1:
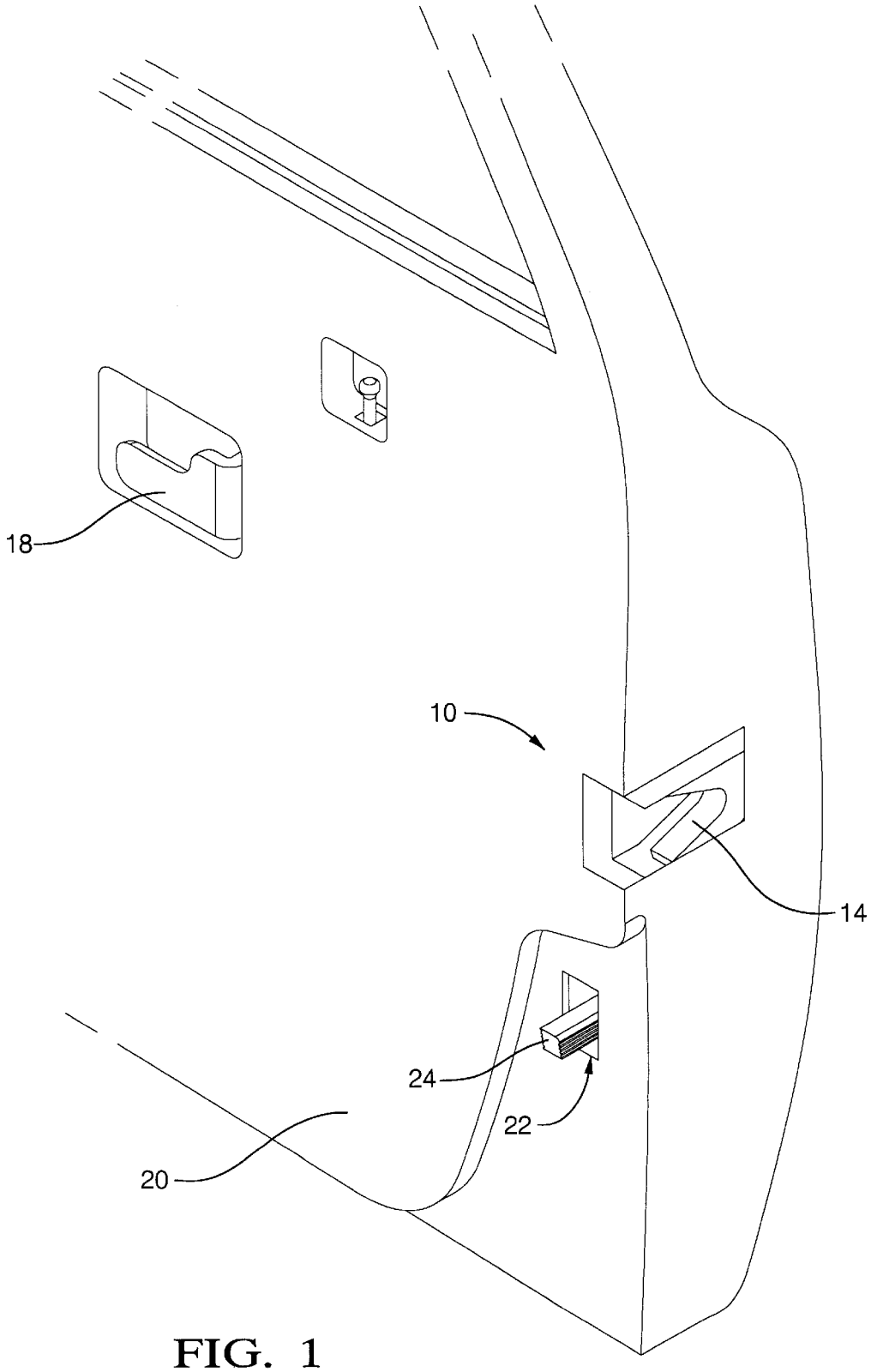
FIG. 1 is a perspective view of a vehicle door showing an inside latch handle, a latching assembly and a child security lock pin.

Referring to the Figures wherein like numerals indicate like or corresponding parts throughout the several views, a door latch assembly with a power child security lock is generally shown at 10.

The door latch 10 generally includes an enclosure 12 and several components disposed on or in the enclosure. Some of the components relate to the basic latching and unlatching functions. Other components relate to the power-operated child security lock.

First, a latching assembly 14 is disposed in the enclosure 12 and is adapted to move between an unlatched configuration and a latched configuration. In other words, the latching assembly 14 can move from one configuration to the other—and back again. The present latching assembly 14 is a fork bolt type of latching assembly as shown in the figures. The latching assembly 14 includes a fork bolt and certain other parts, although the exact number and arrangement of the parts is not critical to the invention.

An inside latch handle assembly, generally indicated at 16, is disposed adjacent the latching assembly 14 for transferring motion to the latching assembly 14 in response to an actuator to move the latching assembly to its unlatched configuration. The "actuator" is a general term that may include manual or power systems. For example, the term may include a person who grasps and pulls an inside latch handle 18 on the vehicle door 20. In such a case, there is some link (not shown) between the inside latch handle 18 and the inside latch handle assembly 16 that is part of the subject door latch 10. Alternatively, the "actuator" may be a power mechanism that effects unlatching through a motion-creating force.

These components of the door latch 10—the ones relating to the latching and unlatching functions—may assume many forms. The invention is not dependent on these components having any particular arrangement or form. Preferably, the enclosure 12, the latching assembly 14, and the inside latch handle assembly 16 are a unit in the form of a basic door latch—in other words, a door latch without any child security lock assembly. Such a basic door latch assembly is well-known. It is shown in U.S. Pat. No. 4,756,563 granted to Stephen L. Garwood and Jeffrey L. Konchan, and U.S. Pat. No. 5,054,827 granted to Jeffrey L. Konchan and Jiri Paulik. The teachings of these patents are incorporated here by reference.

Figure 4:
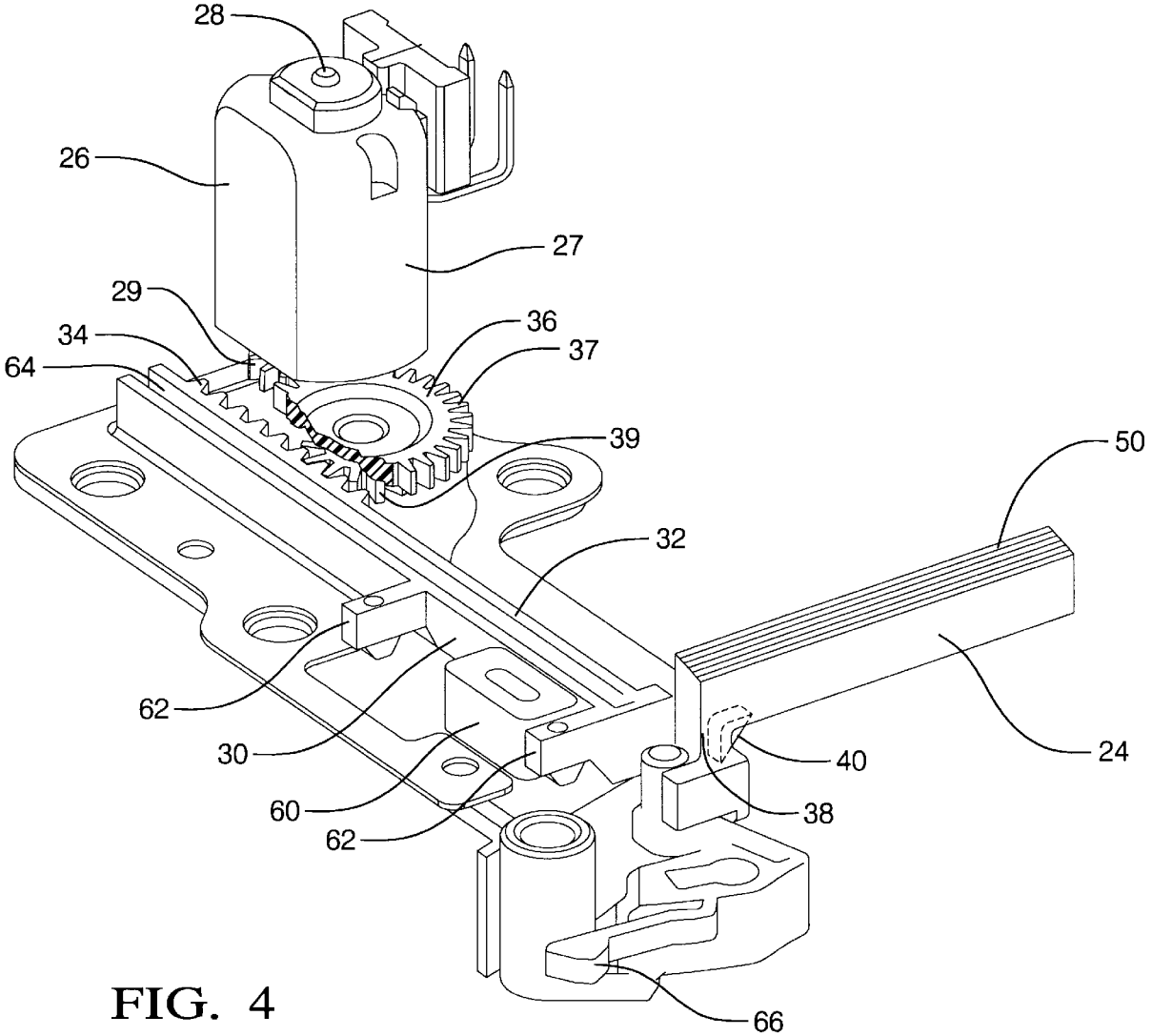
FIG. 4 is a perspective view of the child security lock assembly with the housing removed to show the elements of the child security lock assembly.
Figure 5A:
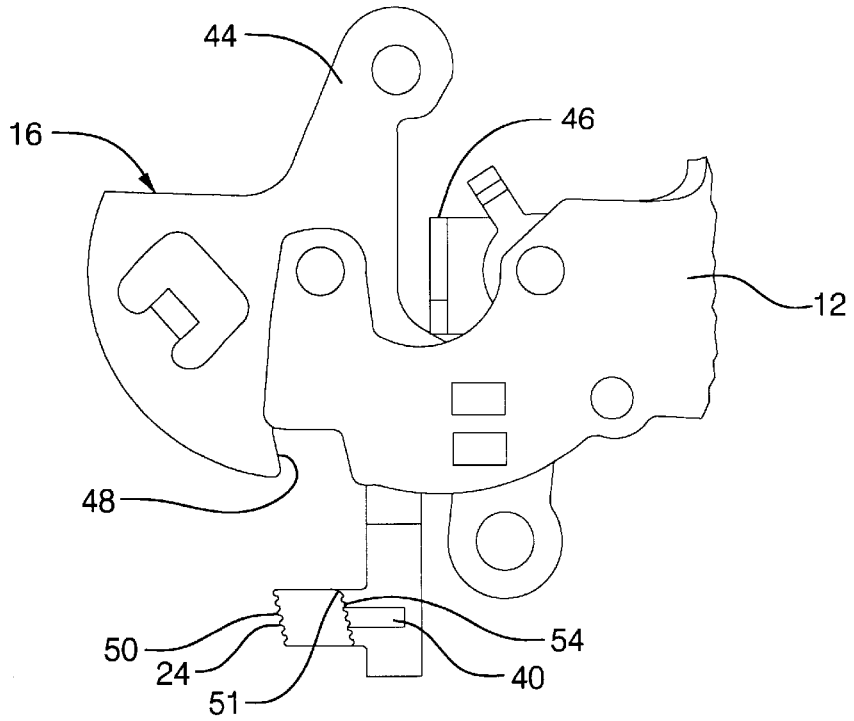
FIG. 5A is a front view of the lock pin and portions of the latching assembly, with the lock pin in the unlocked configuration.
Figure 5B:
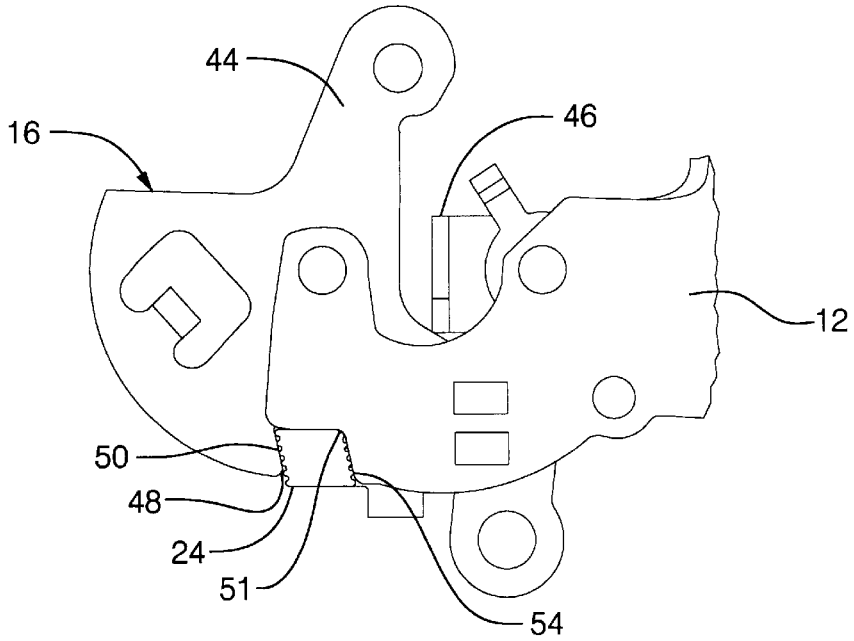
FIG. 5B is a view similar to the view in FIG. 5A showing the lock pin in the locked position.

In addition to this basic door latch, there is also a child security lock assembly associated with the inside latch handle assembly, and generally indicated at 22. The child security lock assembly 22 includes a lock pin 24 moveable between two positions. FIGS. 5A and 5B illustrate the two positions. The first position (FIG. 5B) is a locked position in which the lock pin 24 engages the inside latch handle assembly 16 to block, arrest, freeze or otherwise prevent any motion transfer to the latching assembly 14. The second position (FIG. 5A) is an unlocked position in which the lock pin 24 disengages the inside latch handle assembly 16 to allow motion transfer to the latching assembly 14. Thus, the action of the child security lock assembly 22 is to block out rather than to disengage, or free-wheel, or interrupt As shown in FIG. 4, the child security lock assembly 22 also includes a motor assembly 26 disposed adjacent the lock pin 24, and a linkage 30 interconnecting the lock pin 24 and the motor assembly 26 wherein the motor assembly controls movement of the lock pin.

The motor assembly 26 includes an electric motor 27, a motor shaft 28, and a motor gear 29 disposed on the shaft 28. The motor 27 connects to some external power source (not shown) and a remote control (not shown). The remote control may be located in some convenient position—perhaps near the driver seat in the vehicle.

The linkage 30 includes an elongated rack 32 having a first end and a second end, with a plurality of rack teeth 34 disposed on the first end. The teeth 34 extend along the first end as shown in FIG. 4 for a few centimeters.

The linkage 30 further includes a pinion 36 interconnecting the rack teeth 34 and the motor gear 29. The pinion 36 includes two sets of circular gear teeth that are concentrically arranged. A portion of the pinion 36 is cut away in FIG. 4 to illustrate this particular arrangement. An outer set of gear teeth 37 engages the teeth of the motor gear 29. An inner set of gear teeth 39 engages the rack teeth 34. Other arrangements are possible. The rack 32, the pinion 36, and the motor gear 29 are all made from a suitable plastic material.

The lock pin 24 is disposed on the second end of the rack 32 in a manner perpendicular to the rack. The lock pin 24 extends away from the elongated part of the rack 32 for a distance of several centimeters. In the preferred case, the lock pin 24 is molded as part of the rack 32 to create an "L" shaped member. A spacer section 38 supports the lock pin 24 a predetermined distance above the top of the rack 32 as shown in FIG. 4. A gusset 40 extends between the rack 32 and the lock pin 24 to support the lock pin.

Figure 3A:
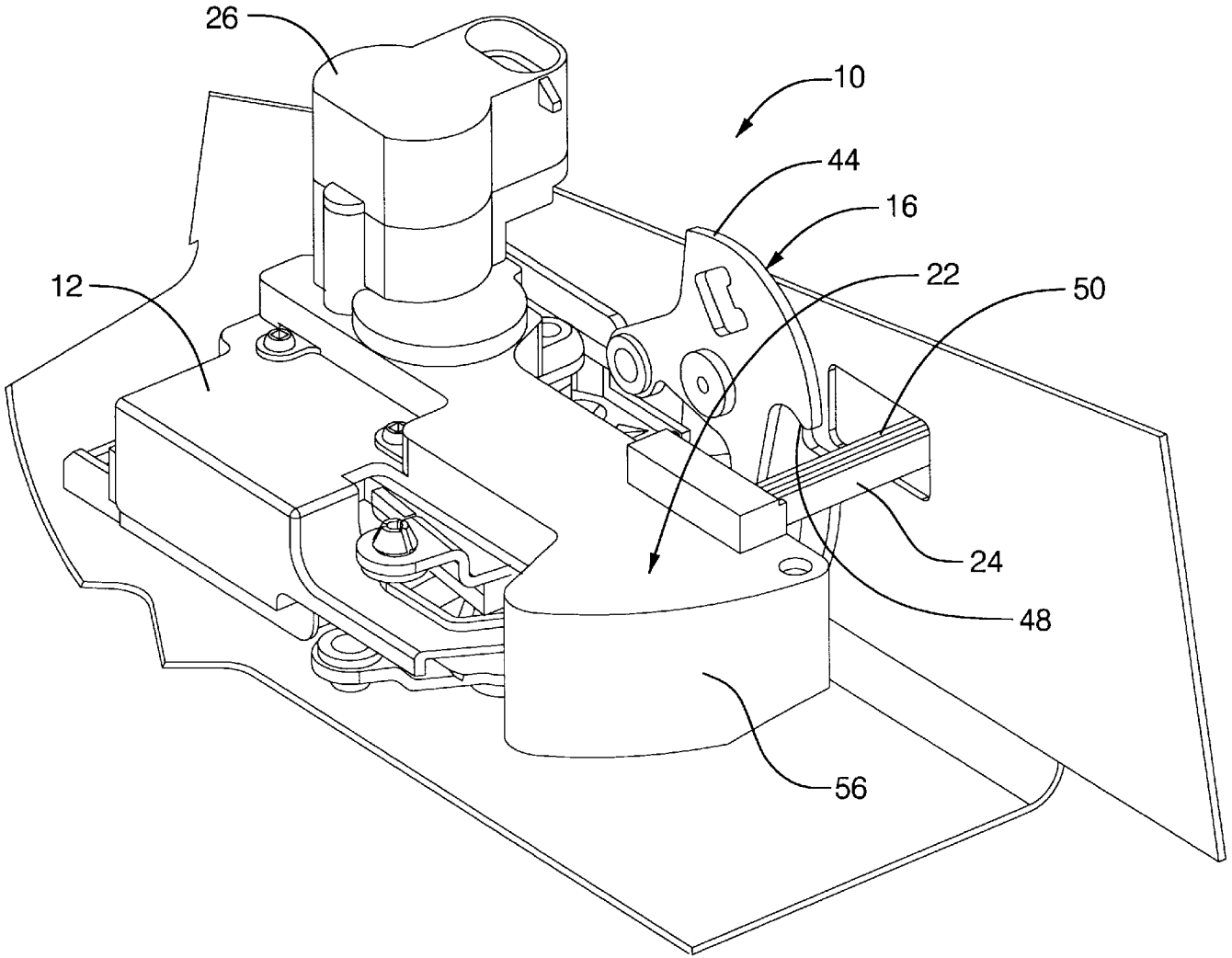
FIG. 3A is a bottom perspective view similar to the view in FIG. 2, but taken from an angle inside the door, showing the child security lock in the unlocked position.
Figure 3B:
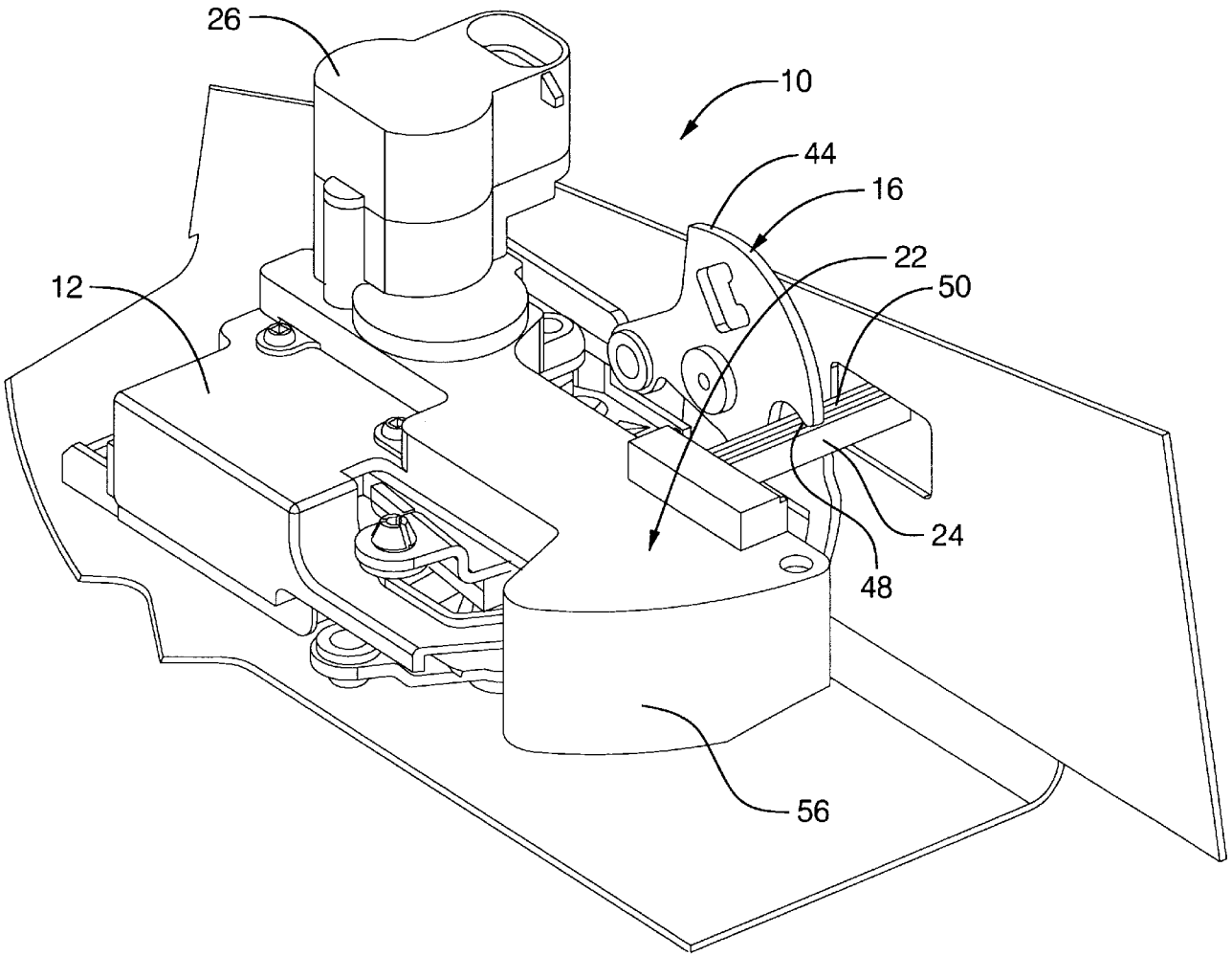
FIG. 3B is a view similar to the view in FIG. 3A showing the child security lock in the locked position.

The inside latch handle assembly 16 includes at least first and second motion transferring elements 44, 46 disposed in series wherein the first motion transferring element 44 transfers motion to the second motion transferring element 46, and the second motion transferring element 46 transfers motion to the latching assembly 14. The manner in which this may be accomplished can vary. Examples are shown in U.S. Pat. Nos. 4,756,563 and 5,054,827. One of the motion transfer elements—in this case the first motion transferring element 44—is a lever pivotally mounted on the enclosure 12 for transferring motion—eventually, by way of other parts—to the latching assembly 14. The lever 44 defines some sort of abutment 48 for the lock pin 24 to abut when the lock pin is in the locked position so that the lock pin can prevent the lever 44 from transferring any motion to the latching assembly 14. FIGS. 5A and 5B illustrate the situation best. FIGS. 3A and 3B also illustrate the situation, where the lever 44 defines a concave section having a side that forms the abutment 48. This particular lever 44 is part of the well-known door latch referred to above in the U.S. Pat. Nos. 4,756,563and 5,054,827. Accordingly, the lock pin 24—when in the locked position—extends into the concave section to prevent pivoting of the lever 44 and to prevent motion transfer to the latching assembly 14.

The lock pin 24 has an angled surface 50 conforming to the angle of the side forming the abutment 48. The lock pin 24 also has a radius 51 and a another angled surface 54 parallel to surface 50 to conform to the space defined in part by the enclosure 12 as shown in FIGS. 5A and 5B. If a person tries to pull the inside latch handle 18 while the child security lock is engaged, the surface 48 will abut the lock pin 24 along surface 50. The lock pin 24 is further backed by the enclosure 12. Thus, the lever 44 cannot pivot to translate motion to the element 46 and eventually to the latching assembly.

The door latch 10 further includes a housing 56 for enclosing the motor assembly 26 and the linkage 30. The housing 56 defines an elongated opening 58 providing clearance for the lock pin 24 as it moves between the locked and unlocked positions. The housing 56 includes at least two detent indentations inside the housing (not shown). The housing 56 further includes features for guiding and supporting the rack 32 as it shuttles back and forth in response to the motor 27. One feature is a bumper 60 disposed adjacent the rack 32. (FIG. 4) The rack 32 has corresponding first and second limit arms 62 spaced apart from each other and extending away from the rack 32 in the perpendicular manner shown in FIG. 4. These limit arms 62 extend on either side of the bumper 60 to limit the reciprocating movement of the rack 32. Another feature in the housing for guiding and supporting the rack is an elongated tongue or flange (not shown). This tongue or flange extends matingly into an elongated linear groove 64 in the rack 32.

The linkage 30 includes a detent 66 engaging the detent indentations (not shown) in the housing 56. The detent 66 is moveable between the indentations. When the housing 56 is assembled over the linkage 30, the detent 66 engages the housing's detent indentations. This arrangement of the detent 66 and the corresponding indentations provides sufficient holding force for maintaining the rack 32—and therefore the lock pin 24—in the locked or unlocked postion. The holding force can be overcome with the force of the motor 27, or with a force applied by a human finger.

Figure 2:
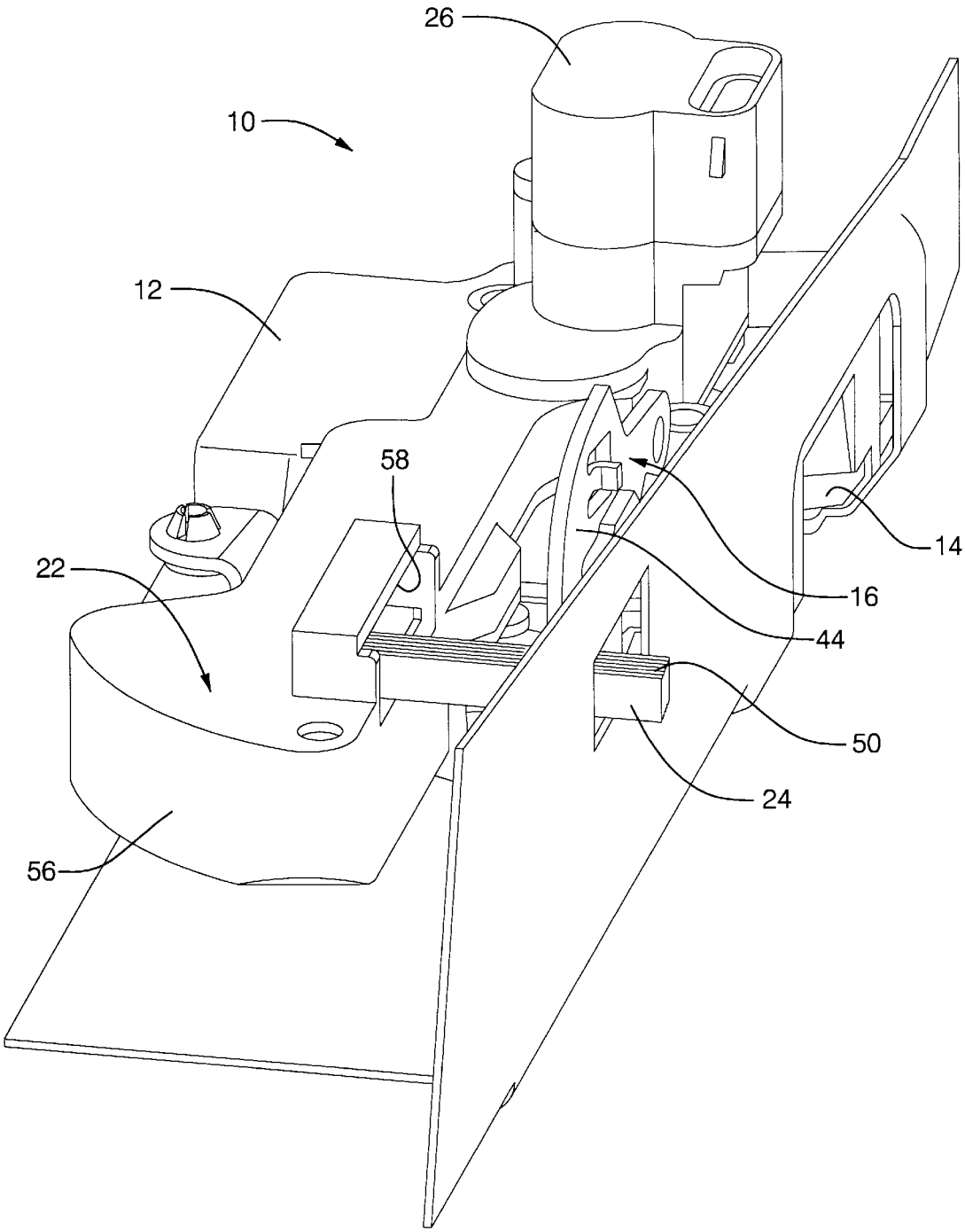
FIG. 2 is a bottom perspective view taken from outside the door showing a portion of the door and the latching assembly with the child security lock assembly.

The lock pin 24 has a length specially sized so that it extends through a slot in the vehicle door 20 to allow for manual operation. This is shown best in FIGS. 1, 2, and 3.

The entire power child security lock assembly 22, including the housing 56, may be viewed as a unit; and this entire unit can be fastened to the side of the existing door latch with fasteners as shown in FIGS. 3A and 3B. This assembly 22 was adapted from an earlier actuator assembly that was used to actuate various door systems including a deadbolt system. The earlier actuator assembly was altered for the present invention by adding the lock pin 24 to the end of the rack 32 in the manner shown, and by forming the elongated opening 58 in the housing 56.

In operation, one can operate the child security lock 22 either manually or with power. In the case of manual operation, one can simply open the vehicle door 20 and move the lock pin 24 upwardly. As shown in FIGS. 5A and 5B, this will place the lock pin 24 adjacent the lever 44 of the inside latch handle assembly 16, and block any motion transfer from this lever 44 to parts such as 46 that will in turn transfer motion to the latching assembly 14.

In the case of power operation, a person can remotely operate the motor 27 with a switch (not shown). The motor 27 will then drive the rack 32—and thus the lock pin 24—by means of the gear teeth on the motor gear 29, the pinion 36 and the rack itself.

We claim:

1. A door latch for mounting on a vehicle door comprising:

an enclosure;

a latching assembly disposed in the enclosure and adapted to move between an unlatched configuration and a latched configuration;

an inside latch handle assembly disposed adjacent the latching assembly for transferring motion to the latching assembly in response to an actuator to move the latching assembly to the unlatched configuration; and a child security lock assembly for the inside latch handle assembly, the child security lock assembly including:

a lock pin moveable between a locked position in which the lock pin engages the inside latch handle assembly to prevent any motion transfer to the latching assembly, and an unlocked position in which the lock pin disengages the inside latch handle assembly to allow motion transfer to the latching assembly, the lock pin being moveable both manually and through a force from a power actuator, and the power actuator including a motor assembly disposed adjacent the lock pin, and a linkage interconnecting the lock pin and the motor assembly wherein the motor assembly controls movement of the lock pin, the motor assembly having a motor, a motor shaft and a motor gear disposed on the shaft, the linkage having a pinion and a rack, the rack having a first end and a second end, with a plurality of rack teeth disposed on the first end and with the lock pin disposed on the second end, the lock pin perpendicular to the rack, the pinion intercornecting the rack teeth and the motor gear.

2. The door latch of claim 1 wherein the inside latch handle assembly includes at least first and second motion transferring elements disposed in series wherein the first motion transferring element transfers motion to the second motion transferring element, and the second motion transferring element transfers motion to the latching assembly.

3. The door latch of claim 2 wherein one of the motion transfer elements is a lever pivotally mounted on the enclosure for transferring motion to the latching assembly.

4. The door latch of claim 3 wherein the lever defines an abutment.

5. The door latch of claim 4 wherein the lock pin abuts the abutment when in the locked position to prevent pivoting of the lever and to prevent motion transfer to the latching assembly.

6. The door latch of claim 5 further including a housing enclosing the motor assembly and the linkage, the housing defining an elongated opening providing clearance for the lock pin.

7. The door latch of claim 6 wherein the linkage includes a detent engaging the housing.

* * * * *